US008382338B2

(12) United States Patent
Lee

(10) Patent No.: US 8,382,338 B2
(45) Date of Patent: Feb. 26, 2013

(54) LIGHT-EMITTING DIODE LENS

(75) Inventor: Chung-En Lee, Taipei (TW)

(73) Assignees: Silitek Electronic (Guangzhou) Co., Ltd., Guangzhou (CN); Lite-On Technology Corp., Taipei (TW)

( * ) Notice: Subject to any disclaimer, the term of this patent is extended or adjusted under 35 U.S.C. 154(b) by 151 days.

(21) Appl. No.: 13/070,748

(22) Filed: Mar. 24, 2011

(65) Prior Publication Data

US 2011/0317432 A1 Dec. 29, 2011

(30) Foreign Application Priority Data

Jun. 25, 2010 (CN) ..... 2010 1 0215196

(51) Int. Cl.
*F21V 3/00* (2006.01)

(52) U.S. Cl. ..... 362/311.06; 362/336

(58) Field of Classification Search ..... 362/331–336, 362/268, 311.01–311.06, 311.09–311.1
See application file for complete search history.

(56) References Cited

U.S. PATENT DOCUMENTS

| | | | | |
|---|---|---|---|---|
| 7,857,497 | B2 * | 12/2010 | Koike et al. | 362/545 |
| 7,985,009 | B2 * | 7/2011 | Ho | 362/335 |
| 2006/0198144 | A1 * | 9/2006 | Miyairi et al. | 362/257 |
| 2007/0029563 | A1 * | 2/2007 | Amano et al. | 257/98 |
| 2011/0235338 | A1 * | 9/2011 | Chen et al. | 362/311.02 |

* cited by examiner

*Primary Examiner* — Julie Shallenberger
(74) *Attorney, Agent, or Firm* — Rosenberg, Klein & Lee

(57) ABSTRACT

A light-emitting diode (LED) lens for covering a LED light source includes a lens body made of a transparent material. The lens body has a light-exit surface and a light-entrance portion. The light-exit surface is configured along the longitudinal direction into a pair of convex surface areas and a concave surface area interconnecting the convex surface areas. The concave surface area has minimum dimensions smaller than maximum dimensions of each of the convex surface areas along first and second transverse directions. The light-entrance portion is adapted for receiving the LED light source, and has a light-incident surface. The light-incident surface has a pair of end portions opposite to each other along the longitudinal direction and extending inclinedly away from the light-exit surface and away from each other.

10 Claims, 5 Drawing Sheets

LIGHT-EMITTING DIODE LENS

CROSS-REFERENCE TO RELATED APPLICATION

This application claims priority of Chinese Application No. 201010215196.8, filed on Jun. 25, 2010.

BACKGROUND OF THE INVENTION

1. Field of the Invention

The present invention relates to a lens, more particularly to a light-emitting diode lens.

2. Description of the Related Art

Light-emitting diodes (LEDs) are known to have advantages such as high efficiency, long service life, and low power consumption, and are gradually replacing conventional illuminating devices in various applications, such as display panels.

However, for applications that require shaped illumination fields (e.g., street illumination), correction of the illumination fields of the LEDs is required.

SUMMARY OF THE INVENTION

Therefore, an object of the present invention is to provide a LED lens that is capable of shaping illumination field of a LED light source into rectangular form.

The light-emitting diode (LED) lens of the present invention for covering a LED light source includes a lens body made of a transparent material. The lens body has one side formed with a light-exit surface which has a length along a longitudinal direction and which is configured along the longitudinal direction into a pair of convex surface areas and a concave surface area interconnecting the convex surface areas. The concave surface area has a minimum width along a first transverse direction smaller than a maximum width of each of the convex surface areas along the first transverse direction. The first transverse direction is transverse to the longitudinal direction. The lens body further has another side opposite to the light-exit surface. The concave surface area further has a minimum distance from the another side along a second transverse direction smaller than a maximum distance of each of the convex surface areas from the another side along the second transverse direction. The second transverse direction is transverse to the longitudinal direction and the first transverse direction.

The another side of the lens body is recessed to form a light-entrance portion adapted for receiving the LED light source. The light-entrance portion has a light-incident surface. The light-incident surface has a pair of end portions opposite to each other along the longitudinal direction and extending inclinedly away from the light-exit surface and away from each other. The light-entrance portion has a length along the longitudinal direction shorter than one-half of an overall length of the lens body along the longitudinal direction.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
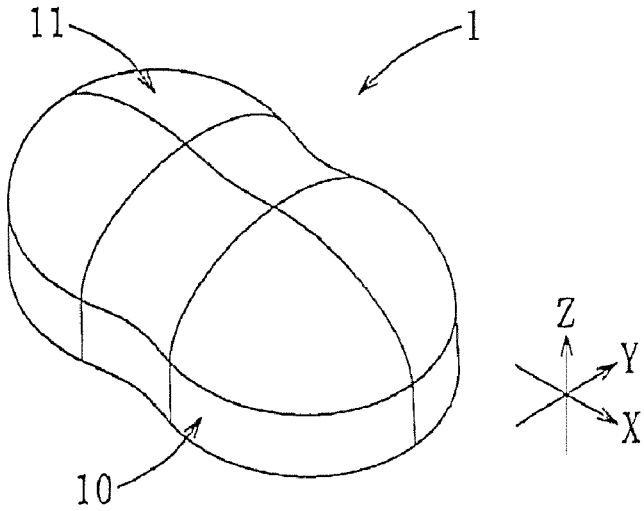
FIG. 1 is a perspective view of a preferred embodiment of the LED lens of the present invention.
Figure 2:
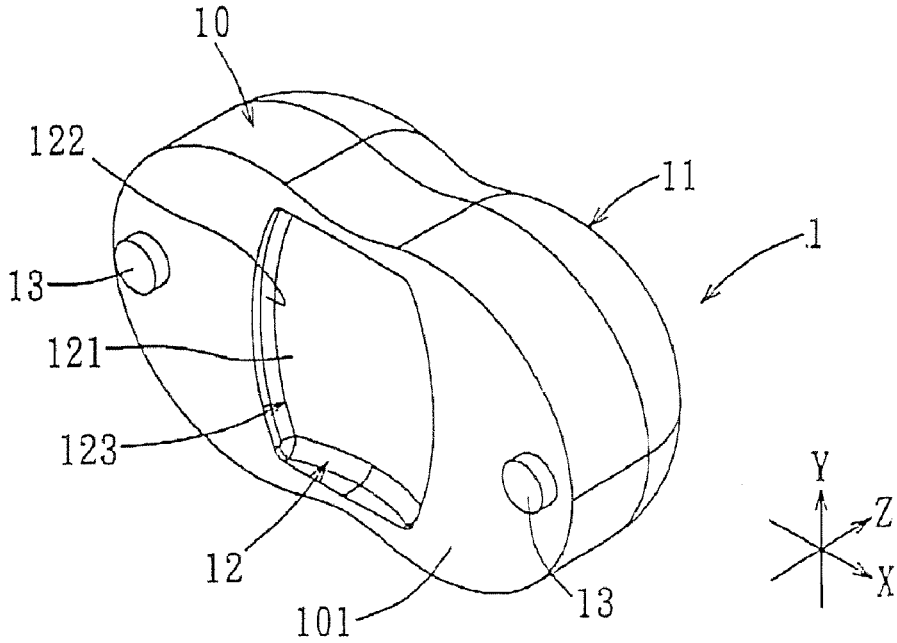
FIG. 2 is a perspective view showing another side of the preferred embodiment.

Referring to FIG. 1 and FIG. 2, the preferable embodiment of the LED lens 1 of the present invention includes a lens body 10 made integrally of a transparent plastic material, such as by injection molding. The lens body 10 has one side (or top side) formed with a light-exit surface 11, and another side (or bottom side) opposite to the light-exit surface 11 and formed with a light-entrance portion 12 and at least one positioning protrusion 13 for positioning purposes.

Figure 3:
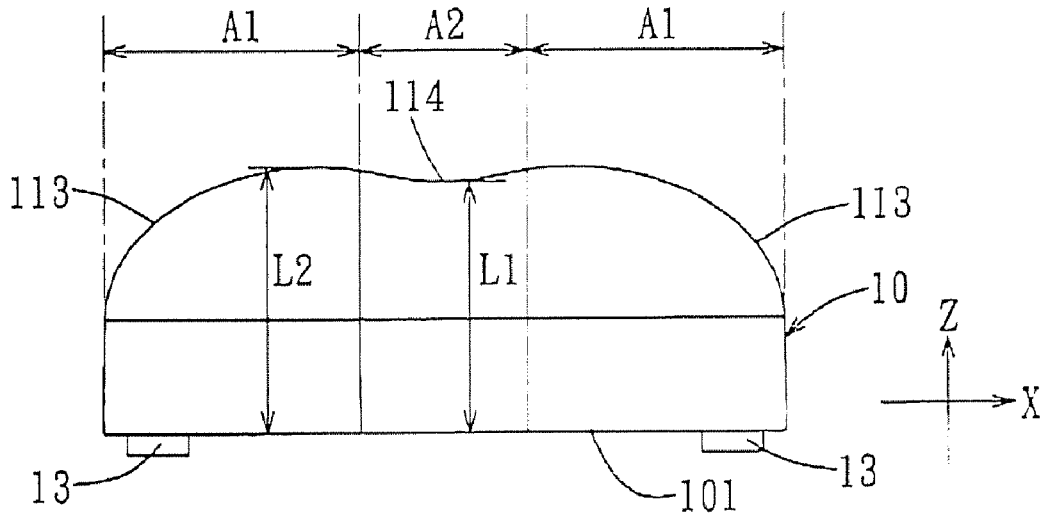
FIG. 3 is a side elevation view of the preferred embodiment.
Figure 4:
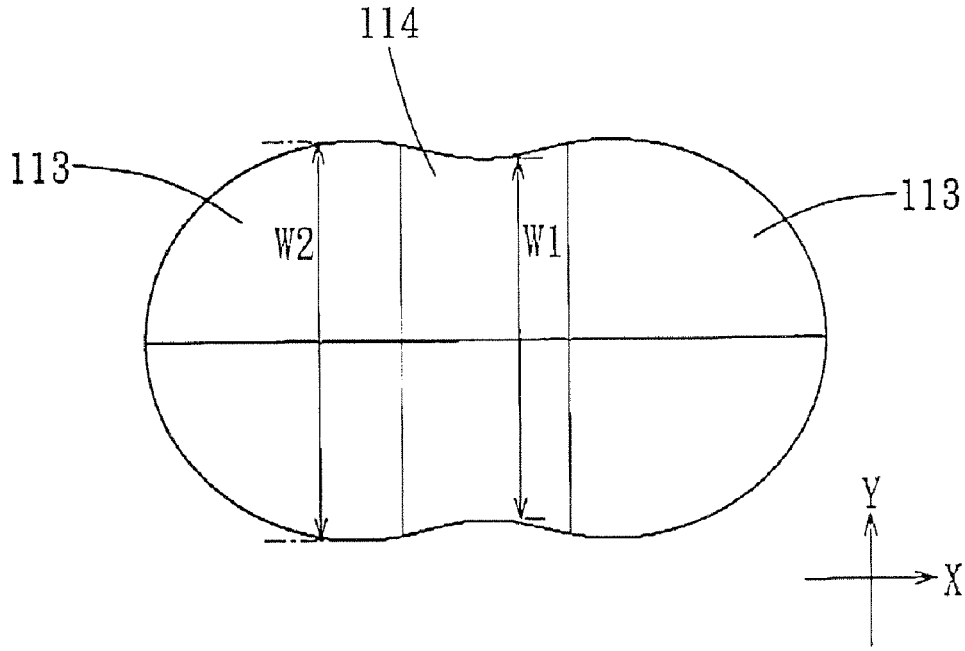
FIG. 4 is a top view of the preferred embodiment.

Referring to FIG. 2 to FIG. 4, the light-exit surface 11 is a substantially gourd-shaped surface. More specifically, the light-exit surface 11 has a length along a longitudinal direction (i.e., x-axis direction) and is configured along the longitudinal direction into a pair of convex surface areas 113 and a concave surface area 114 interconnecting the convex surface areas 113. The convex surface areas 113 are substantially spherical surfaces, and the concave surface area 114 forms a restricted neck relative to the convex surface areas 113. Moreover, the concave surface area 114 has a length (A2) along the longitudinal direction shorter than a length (A1) of each of the convex surface areas 113 along the longitudinal direction. The concave surface area 114 further has a minimum width (W1) along a first transverse direction (i.e., Y-axis direction) smaller than a maximum width (W2) of each of the convex surface areas 113 along the first transverse direction. The first transverse direction is transverse to the longitudinal direction. The concave surface area 114 further has a minimum distance (L1) from the bottom side 101 along a second transverse direction (i.e., Z-axis direction) smaller than a maximum distance (L2) of each of the convex surface areas 113 from the bottom side 101 along the second transverse direction. The second transverse direction is transverse to the longitudinal direction and the first transverse direction. The light-exit surface 11 has a first axis of symmetry along the longitudinal direction and a second axis of symmetry along the first transverse direction.

Figure 6:
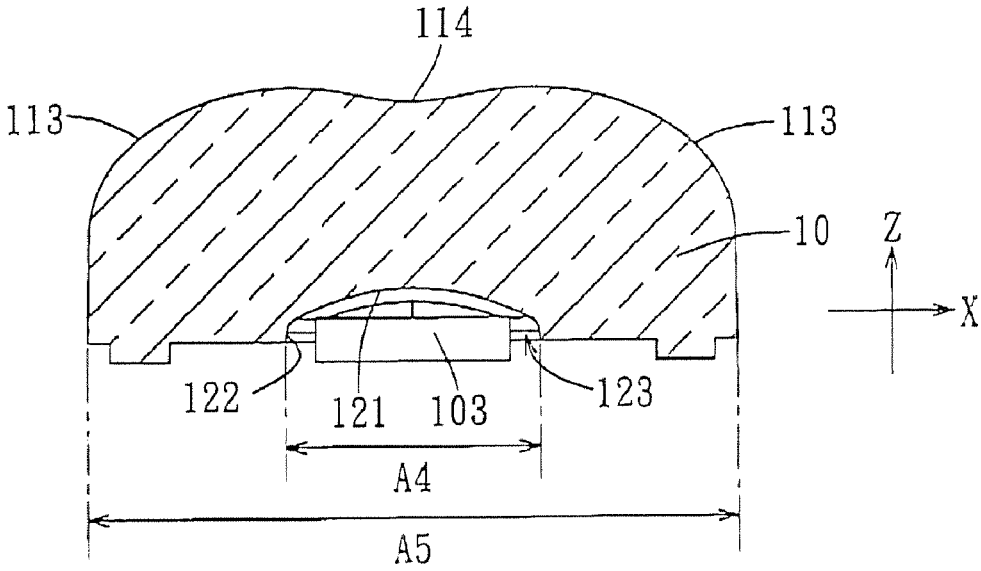
FIG. 6 is a cross-sectional view along a longitudinal direction of the preferred embodiment with the LED light source received in the light-entrance portion.

Referring to FIG. 2 and FIG. 6, the bottom side 101 of the lens body 10 is recessed to form the light-entrance portion 12 that is in aligned with the concave surface area 114 along the second transverse direction. In this embodiment, the light-entrance portion 12 has a light-incident surface 121, and the light-incident surface 121 has a pair of end portions opposite to each other along the longitudinal direction and extending inclinedly away from the light-exit surface 11 and away from each other. Preferably, the light-incident surface 121 is a curved surface in a shape of a section of a wine barrel. In other words, referring to FIG. 6, the light-incident surface 121 has a curved cross-section along the longitudinal direction that opens away from the light-exit surface 11. The light-entrance portion 12 further has a surrounding surface 122 extending from a periphery of the light-incident surface 121 toward the bottom side 101 of the lens body 10. The surrounding surface 122 and the light-incident surface 121 cooperate to define a space 123 adapted for receiving a LED light source 103 (for example, a LED package or a light-emitting chip). Furthermore, the light-entrance portion 12 has a length (A4) along the longitudinal direction shorter than one-half of an overall length (A5) of the lens body 10 along the longitudinal direction.

Figure 5:
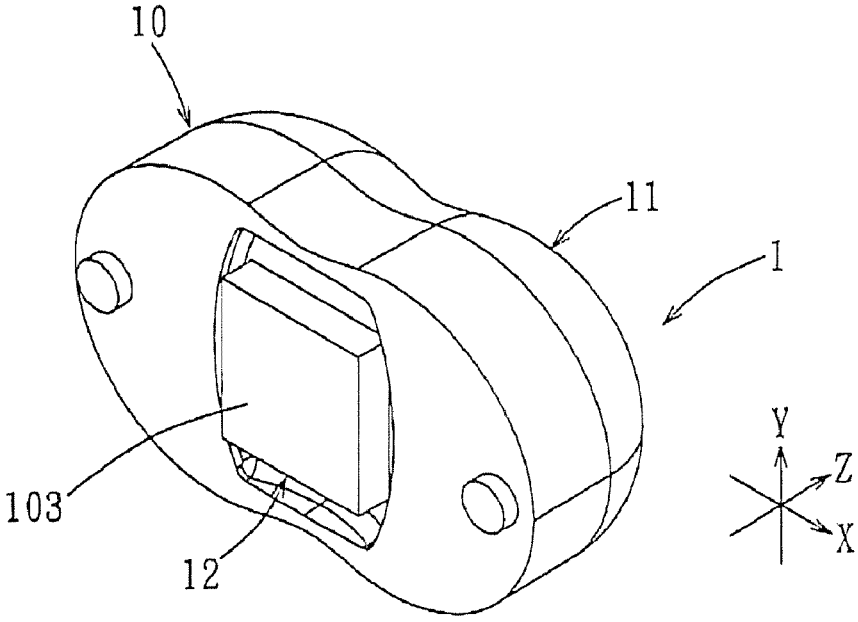
FIG. 5 is a view similar to FIG. 2 but further showing a LED light source received in a light-entrance portion.
Figure 7:
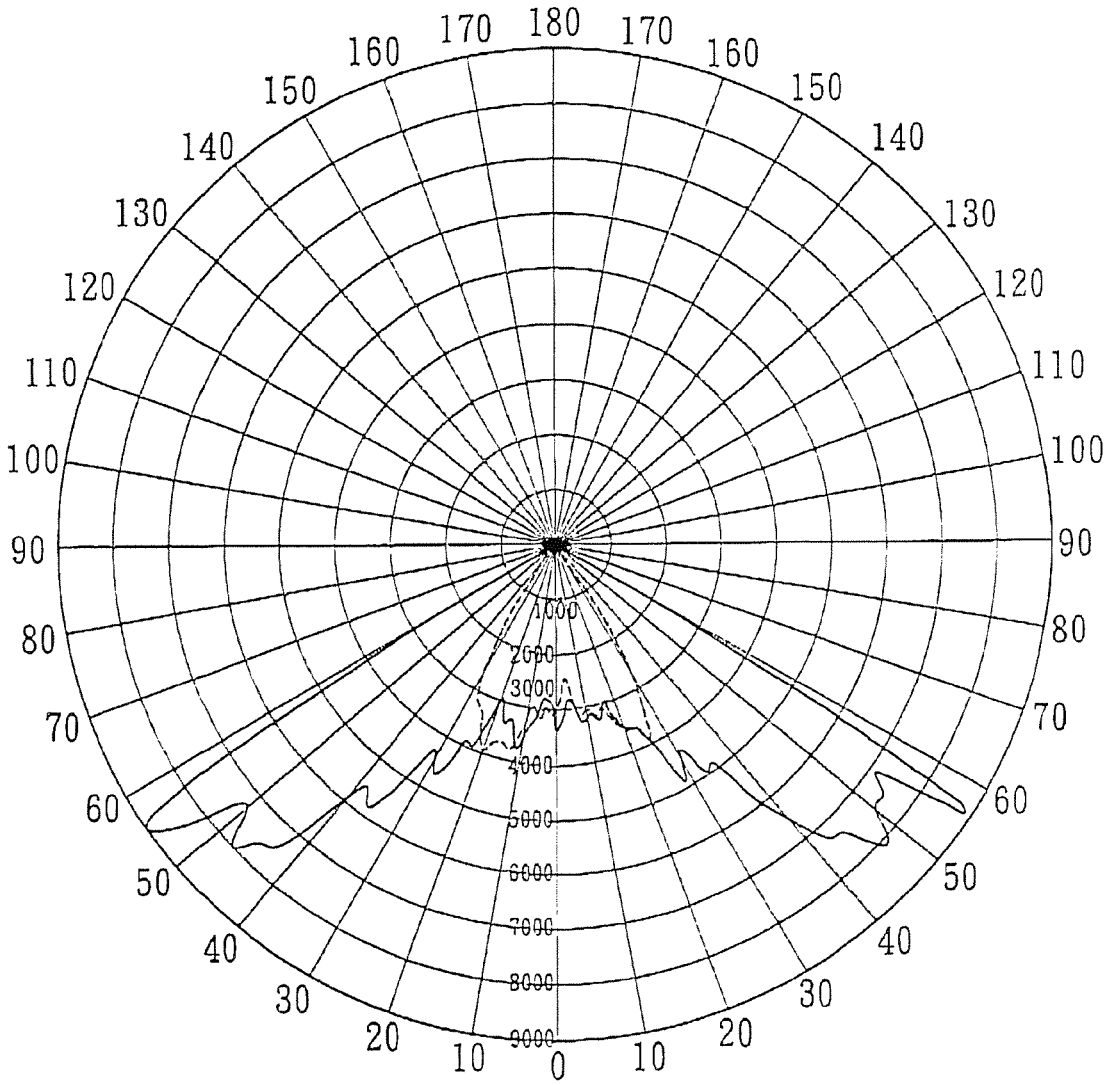
FIG. 7 is a Candela distribution diagram of the preferred embodiment.
Figure 8:
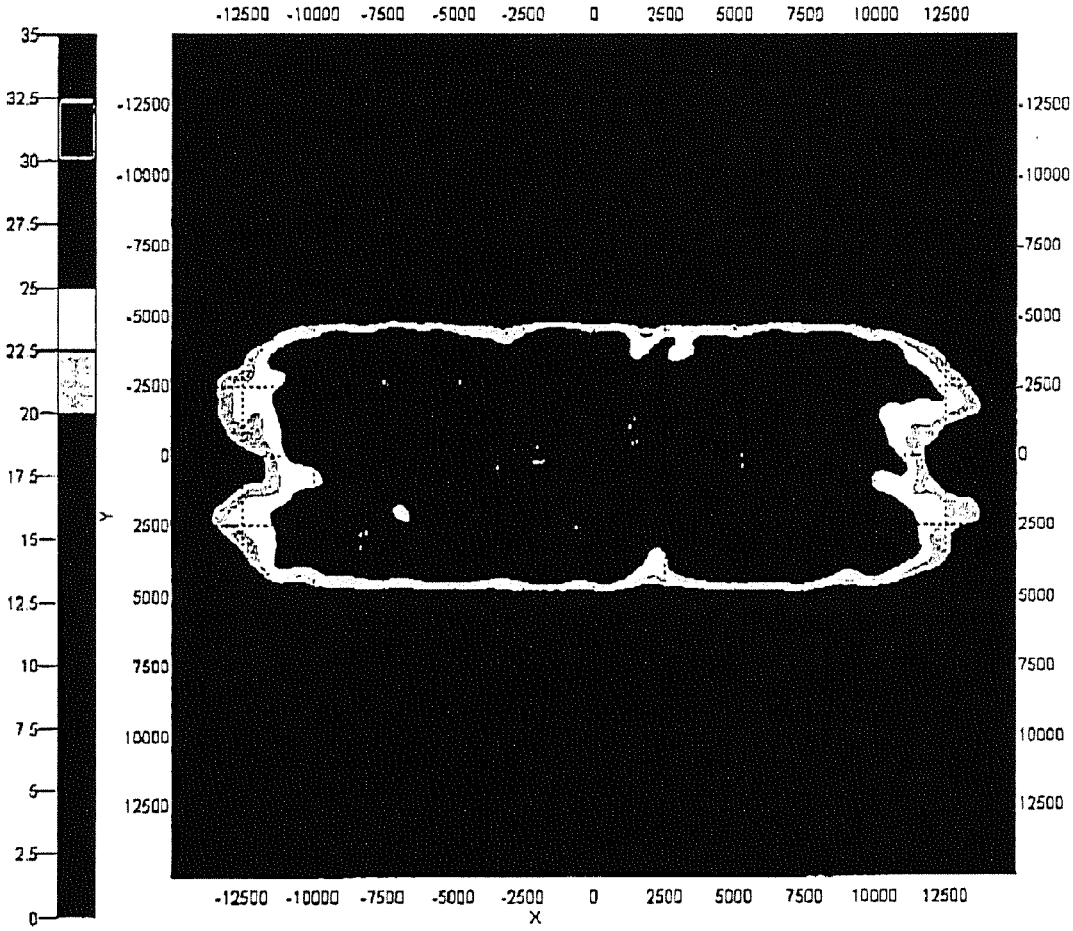
FIG. 8 is a light shape diagram of the preferred embodiment.

Referring to FIG. 5 to FIG. 7, a large portion of light rays emitted from the light source 103 is refracted by the light-incident surface 121, enters the lens body 10, is refracted by the light-exit surface 11 and exits the light-exit surface 11 at a 60-degree angle relative to an optical axis of the LED lens 1. When the light rays pass through the light-incident surface 121, the light rays are refracted according to the curved design of the light-incident surface 121, toward the longitudinal direction in the lens body 10. Moreover, the light rays will not be overly concentrated on the concave surface area 114 since the concave surface area 114 forms a restricted neck relative to the convex surface areas 113. In this way, the light rays are distributed uniformly on the concave surface area 114 and the convex surface areas 113, and the illumination field is shaped into rectangular form as evident from the light shape diagram shown in FIG. 8.

In summary, the illumination field of the light source 103 can be shaped into rectangular form in view of the designs of the light-incident surface 121 and the light-exit surface 11 of the LED lens 1 of the present invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A light-emitting diode (LED) lens for covering a LED light source, comprising a lens body made of a transparent material, said lens body having one side formed with a light-exit surface, said light-exit surface having a length along a longitudinal direction and being configured along the longitudinal direction into a pair of convex surface areas and a concave surface area interconnecting said convex surface areas, said concave surface area having a minimum width along a first transverse direction smaller than a maximum width of each of said convex surface areas along the first transverse direction, the first transverse direction being transverse to the longitudinal direction, said lens body further having another side opposite to said light-exit surface, said concave surface area further having a minimum distance from said another side along a second transverse direction smaller than a maximum distance of each of said convex surface areas from said another side along the second transverse direction, the second transverse direction being transverse to the longitudinal direction and the first transverse direction, said another side of said lens body being recessed to form a light-entrance portion adapted for receiving the LED light source, said light-entrance portion having a light-incident surface, said light-incident surface having a pair of end portions opposite to each other along the longitudinal direction and extending inclinedly away from said light-exit surface and away from each other, said light-entrance portion having a length along the longitudinal direction shorter than one-half of an overall length of said lens body along the longitudinal direction.

2. The LED lens as claimed in claim 1, wherein said convex surface areas are substantially spherical surfaces, said concave surface area farming a restricted neck relative to said convex surface areas.

3. The LED lens as claimed in claim 2, wherein said light-exit surface is a substantially gourd-shaped surface.

4. The LED lens as claimed in claim 1, wherein said light-incident surface has a curved cross-section along the longitudinal direction that opens away from said light-exit surface.

5. The LED lens as claimed in claim 4, wherein said light-incident surface is a curved surface in a shape of a section of a wine barrel.

6. The LED lens as claimed in claim 4, wherein said light-entrance portion further has a surrounding surface extending from a periphery of said light-incident surface toward said another side of said lens body, said surrounding surface and said light-incident surface cooperating to define a space adapted for receiving the LED light source.

7. The LED lens as claimed in claim 1, wherein said light-entrance portion further has a surrounding surface extending from a periphery of said light-incident surface toward said another side of said lens body, said surrounding surface and said light-incident surface cooperating to define a space adapted for receiving the LED light source.

8. The LED lens as claimed in claim 1, wherein said light-exit surface has a first axis of symmetry along the longitudinal direction and a second axis of symmetry along the first transverse direction.

9. The LED lens as claimed in claim 1, wherein said another side of said lens body is further formed with at least one positioning protrusion.

10. The LED lens as claimed in claim 1, wherein said concave surface area has a length along the longitudinal direction shorter than a length of each of said convex surface areas along the longitudinal direction, said light-entrance portion being aligned with said concave surface area along the second transverse direction.

* * * * *